United States Patent [19]

Pfieffer et al.

[11] 4,383,637

[45] May 17, 1983

[54] CARTON FOR COMESTIBLES AND STRUCTURE FOR ERECTING SAME

[75] Inventors: Gerald R. Pfieffer, Seattle; Gary W. Robertson, Tacoma; Charles H. Thompson, Woodinville; Jerry D. Williams, Redmond, all of Wash.

[73] Assignee: Container Corporation of America, Chicago, Ill.

[21] Appl. No.: 289,367

[22] Filed: Aug. 3, 1981

[51] Int. Cl.[3] ..... B65D 5/08

[52] U.S. Cl. ..... 229/38; 229/41 C

[58] Field of Search ..... 229/38, 41 C

[56] References Cited

U.S. PATENT DOCUMENTS

| | | | |
|---|---|---|---|
| 1,911,073 | 5/1933 | Dyment | 229/41 C |
| 2,741,416 | 4/1956 | Hileman | 229/41 C |
| 4,146,169 | 3/1979 | Meyers | 229/41 C |
| 4,199,098 | 4/1980 | Lopez | 229/37 R |
| 4,284,205 | 8/1981 | Hirata | 229/41 D |

FOREIGN PATENT DOCUMENTS

| | | | |
|---|---|---|---|
| 2641791 | 3/1978 | Fed. Rep. of Germany | 229/41 C |
| 1330260 | 5/1963 | France | 229/41 C |

*Primary Examiner*—Herbert F. Ross

*Attorney, Agent, or Firm*—Richard W. Carpenter; Davis Chin

[57] ABSTRACT

A carton in the form of a polyhedron of six sides is erected by structure insuring that human hands do not contact the interiors, important in the case of comestibles, such as popcorn.

1 Claim, 6 Drawing Figures

CARTON FOR COMESTIBLES AND STRUCTURE FOR ERECTING SAME

BACKGROUND OF THE INVENTION

1. Field of the Invention

The invention relates generally to cartons in the form of a polyhedron of six side walls, and erected from a flat, folded and glued blank. A feature of the invention is structure for erecting the blank without contact of the interior by human hands, desirable in the case when the carton is loaded with comestibles.

2. The Prior Art

A search of the art was directed to the configuration of the carton and also to the structure for erecting a flat, folded and glued blank into a carton structure.

The search relating to the carton structure developed the following patents:

Brown—U.S. Pat. No. 2,020,353
Hileman—U.S. Pat. No. 2,741,416
Frankenstein—U.S. Pat. No. 2,917,222
Meyers et al—U.S. Pat. No. 4,146,169

None of the above patents teaches a structure whereby a hexagonal bottom panel is provided with upright flanges engaged with slots formed at the vertices between certain adjoining side walls. Also, certain of the side walls are provided with tabs cooperating with said tabs to lock the bottom panel in position.

The search relating to structure for erecting a carton from a folded and glued blank developed the following patents:

Powell—U.S. Pat. No. 2,040,154
Chase—U.S. Pat. No. 4,195,555

Neither patent shows a structure as disclosed herein. Powell requires rotation of a container tube in order to achieve closing of fingers 17 with apertures 16 in closure 14. Chase shows a mandrel in the form a cone-shaped polyhedron, but the erection and closure of the container tube requires the use of a second mandrel to complete the package structure.

SUMMARY OF THE INVENTION

The invention herein comprehends a structure for forming a carton in the form of a polyhedron with a hexagonal bottom panel supported on paired flaps foldably joined to the carton walls and extending inward beneath the bottom panel. The invention structure further is characterized by flanges extending normal to the plane of the bottom panel and cooperating with slots and tabs in certain of the carton walls to maintain the bottom panel in position.

DESCRIPTION OF THE PREFERRED EMBODIMENT

Figure 1:
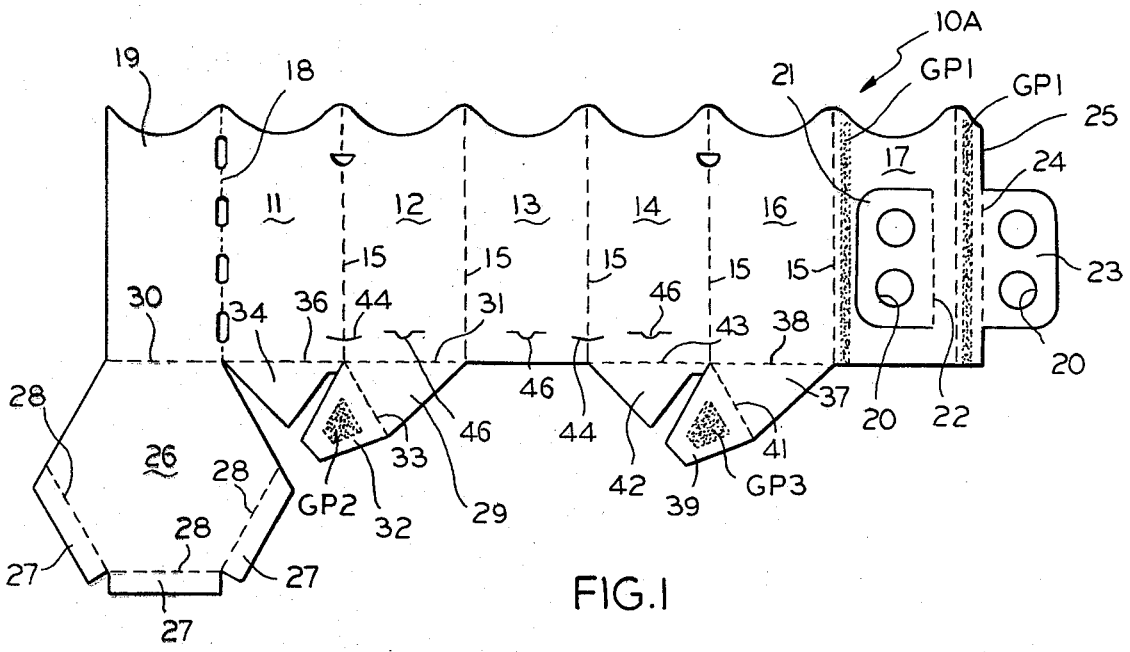
FIG. 1 is a plan view of a cut and scored blank for forming a carton according to the invention.
Figure 3:
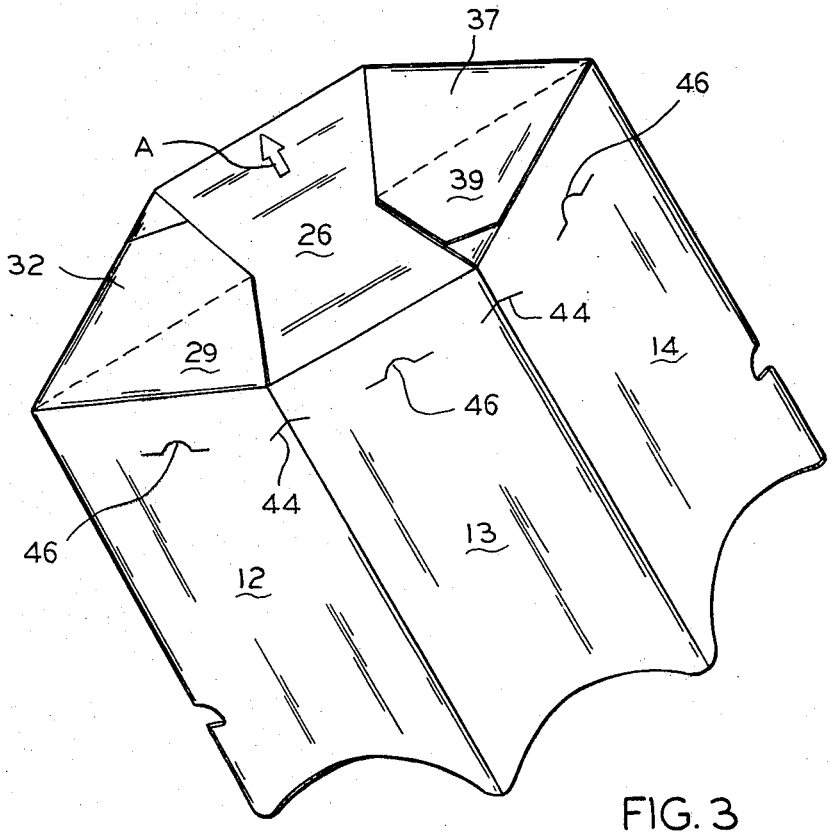
FIG. 3 is a perspective view of the finished container looking at the bottom thereof.
Figure 4:
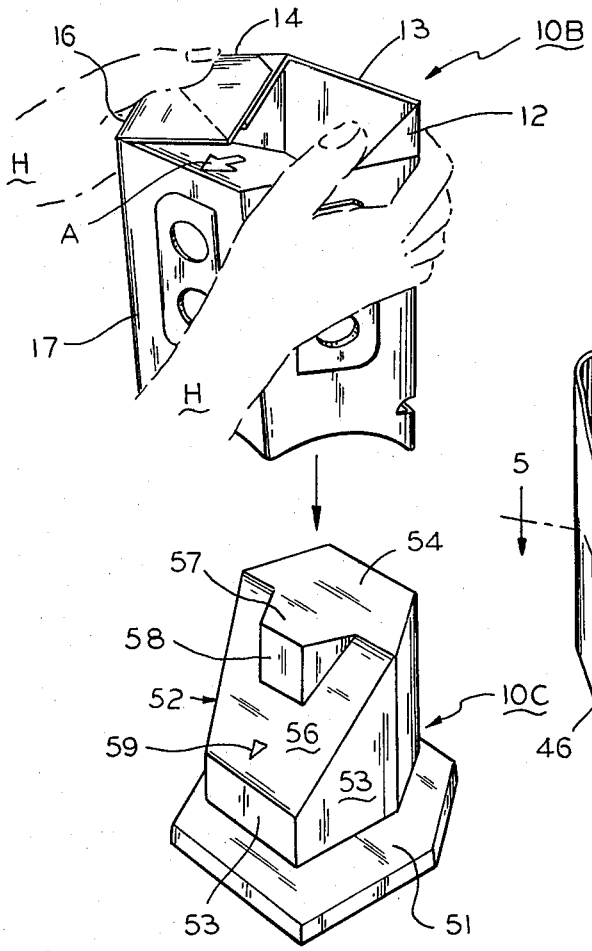
FIG. 4 is a perspective view showing the erection of the carton from a folded and glued carton blank on a mandrel forming part of the invention herein.
Figure 2:
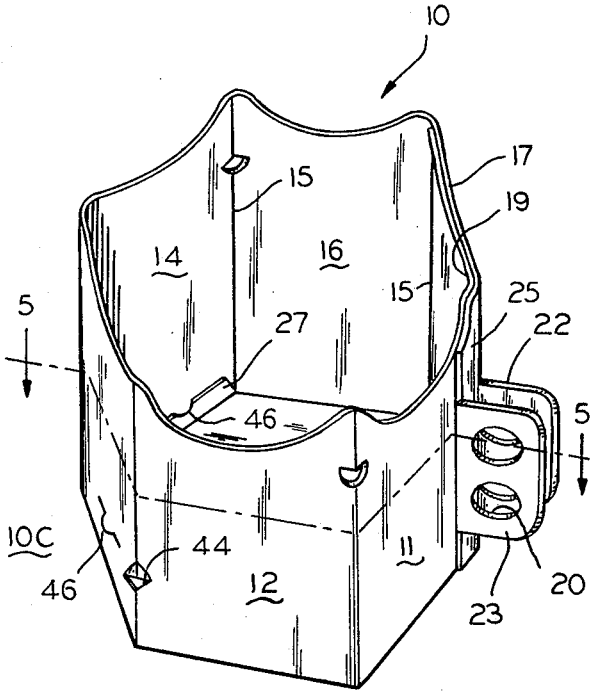
FIG. 2 is a perspective view of the carton formed from the blank of FIG. 1.
Figure 6:
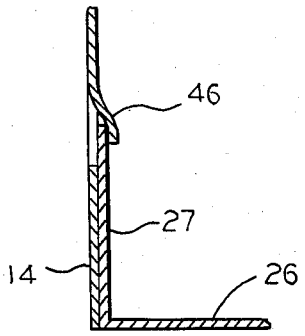
FIG. 6 is a sectional view looking in the direction of the arrows 6—6 of FIG. 5.
Figure 5:
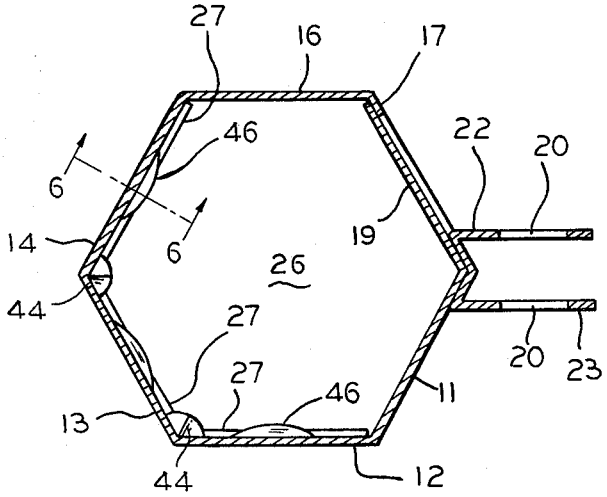
FIG. 5 is a horizontal section taken along the plane 5—5 of FIG. 2, looking in the direction of the arrows.

The carton according to the present invention is denoted by reference numeral 10 and is formed from a cut and scored blank 10A. The latter is folded and glued to provide a partly completed carton 10 which is shown in FIG. 4 in its partly erected condition and denoted by referennce numeral 10B. A mandrel 10C is provided to act upon the partly erected blank 10B to give it its final form as seen in FIG. 2.

Blank 10A is folded and glued and operated upon by mandrel 10C to provide a carton 10 in the form of a polyhedron having six side walls.

It should be noted that the finished structure is particularly adapted to hold comestibles such as french fries, popcorn or the like. The finished structure is formed with its food contacting surfaces being untouched by human hands, desirable to the consuming public. Noreover, the structure is formed from a cut, folded and glued blank occupying very little space compared to the usual tubs.

Blank 10A has side walls 11, 12, 13, 14,16 and 17 joined in the order named along parallel fold lines 15. Outer wall 17 is joined to an inner wall 19 connected to wall 11 along a fold line 18 by a glue patch GP1 on wall 17. Wall 17 has a glue flap 25 with a patch GP1 thereon, flap 25 being joined to wall 11 at patch GP1. Inner wall 19 is first folded against wall 11 along fold line 18, and walls 14, 16 and 17 are folded as a unit about fold line 15 between walls 13 and 14.

Outer wall 17 has a handle element 21 cut therefrom the latter being foldable out of the plane of wall 17 along fold line 22. Wall 17 also has a handle element 23 extending from flap 25 and foldable with respect thereto along a fold line 24. The two handle elements 21 and 23 are folded into facing relationship, and each has finger holes 20 therein.

Inner wall 19 has a hexagonal bottom panel 26 connected thereto along a fold line 30, and the distal ends of panel 26 are provided with flanges 27 connected thereto along fold lines 28, flanges 27 upturning upon erection of cartion 10.

Support for the bottom panel 26 when carton 10 is erected is provided along one side of panel 26 by a gusset flap 29 foldable with respect to wall 12 along fold line 31. Flap 29 is joined by score line 33 to glue tab 32 which has glue patch GP2 thereon. Glue tab 32 is joined to gusset flap 34 foldable with respect to wall 11 along fold line 36. Flap 29 and gusset flap 34 are folded about their respective fold lines 31 and 36 to bring glue patch GP2 into contact with flap 34. This occurs when walls 11 and 12 are folded into contacting relationship.

Diametrically disposed with respect to the aforesaid flaps, and in similar fashion wall 16 is provided with gusset flap 37 joined to wall 16 at fold line 38. Flap 37 has a glue tab 39 with a glue patch GP3 thereon, flap 37 being joined to tab 39 along fold line 41. A gusset flap 42 is joined to wall 14 along fold line 43, and flap 42 is joined to tab 39 upon being folded along lines 38 and 43, and when walls 14 and 16 are folded into contact.

The aforesaid operations on bottom panel 26 and the gusset panels so formed results in a glued and folded flat blank. It is partially erected by hands H engaging the edges where walls 14 and 16 are joined and where walls 11 and 12 are joined. Movement of the hands H toward each other causes the blank to adopt the configuration seen in FIG. 4, whereupon the blank can be placed over mandrel 10C.

It comprises a base 51 surmounted by a polyhedron structure 52 of six sides, walls 53 of which approximate in width the width of the walls of carton 10. Structure 52 has a chamfer surface 56 extending from a short wall 53 to the top surface 54 which includes an extension 57 therefrom with vertical walls 57 extending to the chamfer surface 56. Chamfer surface 56 which is inclined assists in placement of the carton on structure 52.

Structure 52 has debossed indicia 59 which cooperates with an arrow A on bottom panel 26. When arrow A and indicia 59 are aligned the user knows that the partly erected carton is properly positioned for use with structure 52.

The partly erected carton is then moved downward over structure 52. As this is done bottom panel 26 begins to pivot with respect to inside wall 19 by reason of contact of bottom wall 26 with surface 54 of structure 52.

As bottom wall 26 moves to a horizontal position the gusset members at the junctures of walls 14 and 16 and walls 11 and 12 move out of their folded condition to a flattened condition in facing relationship with bottom panel 26.

In the movement of panel 26 flanges 27 thereof become engaged with slots 44 at the vertices of walls 12 and 13 and walls 13 and 14.

Walls 12, 13 and 14 also are provided lock tabs 46 which engage the flanges 27, and which together with slots 44 prevent movement of bottom panel 26.

We claim:

1. A carton formed from a cut and scored blank of paperboard comprising:

(a) a polyhedron having six side walls foldably joined, one of said side walls having an outer wall panel and an equi-size inner wall panel, said outer panel wall overlapping said inner wall panel and being secured thereto to form said polyhedron;

(b) a hexagonal bottom panel foldably joined to a side wall;

(c) a pair of bottom panel supporting triangular folded flaps foldably secured to diametrically opposed side walls and and a glue tab foldably attached to each said flap, a pair of gusset flaps each foldably attached to diametrically opposed side walls and underlying a respective glue tab and secured thereto;

(d) said bottom panel being foldably connected along a fold line to said inner wall panel of said one side wall between said bottom panel supporting flaps;

(e) upturned flanges foldably joined to edges of said bottom panel distal from said fold line;

(f) slots cut in the vertices of certain of said connected side walls remote from said inner wall panel of said one side wall where said bottom panel is connected;

(g) said flanges and said slots cooperating to lock said bottom panel in position when said carton is erected; and (h) tabs formed in the intermediate area of certain connected side walls adjacent said upturned flanges for overlapping said flange in locking relationship.

* * * * *